United States Patent [19]

Wood

[11] 4,102,609

[45] Jul. 25, 1978

[54] VALVE CONTROL SYSTEM FOR AIR POWERED VACUUM PUMP

[75] Inventor: Howard L. Wood, Wolf Point, Mont.

[73] Assignee: Wood's Powr-Grip Co., Inc., Wolf Point, Mont.

[21] Appl. No.: 755,078

[22] Filed: Dec. 28, 1976

Related U.S. Application Data

[63] Continuation-in-part of Ser. No. 612,924, Sep. 12, 1975, abandoned.

[51] Int. Cl.[2] ..... F04B 17/00; F04B 35/00; F01B 7/18; F01L 33/00

[52] U.S. Cl. ..... 417/399; 417/402; 91/318; 91/321; 91/337; 91/341 R; 91/426

[58] Field of Search ..... 417/398, 399, 402, 401; 91/341 R, 337, 321, 322, 335, 318, 346, 426, 443

[56] References Cited

U.S. PATENT DOCUMENTS

| | | | |
|---|---|---|---|
| 2,964,013 | 12/1960 | Mitchell et al. | 91/335 |
| 3,035,676 | 5/1962 | Nallinger | 417/470 |
| 3,216,158 | 11/1965 | Kelsey | 91/342 |
| 3,268,271 | 8/1966 | Yackle | 91/346 |
| 3,299,826 | 1/1967 | Williams | 91/335 |
| 3,387,563 | 6/1968 | Williams et al. | 91/318 |

FOREIGN PATENT DOCUMENTS

| | | | |
|---|---|---|---|
| 1,215,760 | 12/1970 | United Kingdom | 417/401 |

*Primary Examiner*—Carlton R. Croyle
*Assistant Examiner*—Thomas I. Ross
*Attorney, Agent, or Firm*—Clarence A. O'Brien; Harvey B. Jacobson

[57] ABSTRACT

A source of fluid, regulated as to pressure intensity before entry into a control valve assembly, drives a fluid biased piston motor. A mechanically actuated and fluid held valve in the control valve assembly controls pressurization of a pressure chamber in the piston motor displacing the motor piston through its return stroke. Pressure differential on opposite sides of a fluid operated valve actuator insures rapid opening of the valve and holding thereof in its open position during the motor piston return stroke. At the end of the return stroke, the pressure differential is eliminated to allow spring-biased closing of the valve and venting of the pressure chamber.

11 Claims, 7 Drawing Figures

VALVE CONTROL SYSTEM FOR AIR POWERED VACUUM PUMP

BACKGROUND OF THE INVENTION

This application is a continuation-in-part of my prior co-pending application, U.S. Ser. No. 612,924, filed Sept. 12, 1975, now abandoned, and relates to pressure loaded fluid motors of the piston type having a fixed power stroke and return stroke movement under the automatic control of a valve assembly.

Compressed air motor driven pumps of the piston type are well known. Fluid piston motors having control valves that are mechanically displaced by the motor piston at the end of the power stroke are also known. Generally, fluid piston motors of the foregoing type have fluid means for controlling the stroke of the motor piston while the position of the motor piston often influences operation of the control valve assembly through which cycling of the fluid motor is governed. Such prior arrangements are not, however, satisfactory in certain applications.

It is, therefore, an important object of the present invention to provide a control valve assembly for a fluid pressure return type of piston motor having a fixed stroke determined by the motor load and a positive and reliably operating valve arrangement through which a pressure chamber associated with the fluid motor is controllably pressurized and depressurized.

SUMMARY OF THE INVENTION

In accordance with the present invention, a reciprocating fluid motor is provied with a cylindrical housing and has a stroke length fixed by a piston type pump to which the motor is connected. The motor piston is displaced through its power stroke by a pressurized fluid under a regulated inlet pressure and displaced through its return stroke by pressurization of a piston chamber on one axial side of the motor piston. Fluid is supplied to a control valve assembly under the regulated inlet pressure in order to control pressurization of the piston chamber during the return stroke, the piston chamber being depressurized under control of the valve assembly during the power stroke. A valve element associated with the control valve assembly is continuously biased to a closed position by a spring in order to exhaust the piston chamber during the power stroke and is mechanically displaced to an open position by the piston itself as it approaches the end of its power stroke. In the open position of the valve, fluid under the regulated inlet pressure is admitted through a restrictor nozzle and venturi passage to the piston chamber for pressurization thereof during the return stroke of the motor piston at a pressure level slightly lower than the regulated inlet pressure to provide for piston travel. The control valve is held in its open position during the return stroke principally by the differential between the inlet pressure and the pressure of the fluid in the piston chamber. A control diaphragm element is connected to the control valve and separates opposing pressure chambers, one of which senses the pressure in the expanding pressure chamber while the other is pressurized at the constant regulated inlet pressure by the control valve assembly in its open position.

Pressure rapidly increases to the regulated inlet pressure level in the piston chamber after the motor piston reaches the end of its return stroke. Inflow through the nozzle and venturi passage then ceases and pressure within the opposing chambers on opposite sides of the control diaphragm is equalized allowing the control valve element to be displaced to its closed position under a continuous spring bias. The piston chamber is thereby vented to initiate a new operating cycle beginning with the displacement of the motor piston through its power stroke.

The foregoing valve control system is particularly suited for use with a vacuum pump because it provides for variable intensity, fast or slow operation, prolonged maintenance of a static condition and a high degree of efficient air use. It should, however, be appreciated that these advantages will also be applicable to other installations of the valve control system such as air-powered reciprocating liquid pumps and mechanical push-pull systems.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
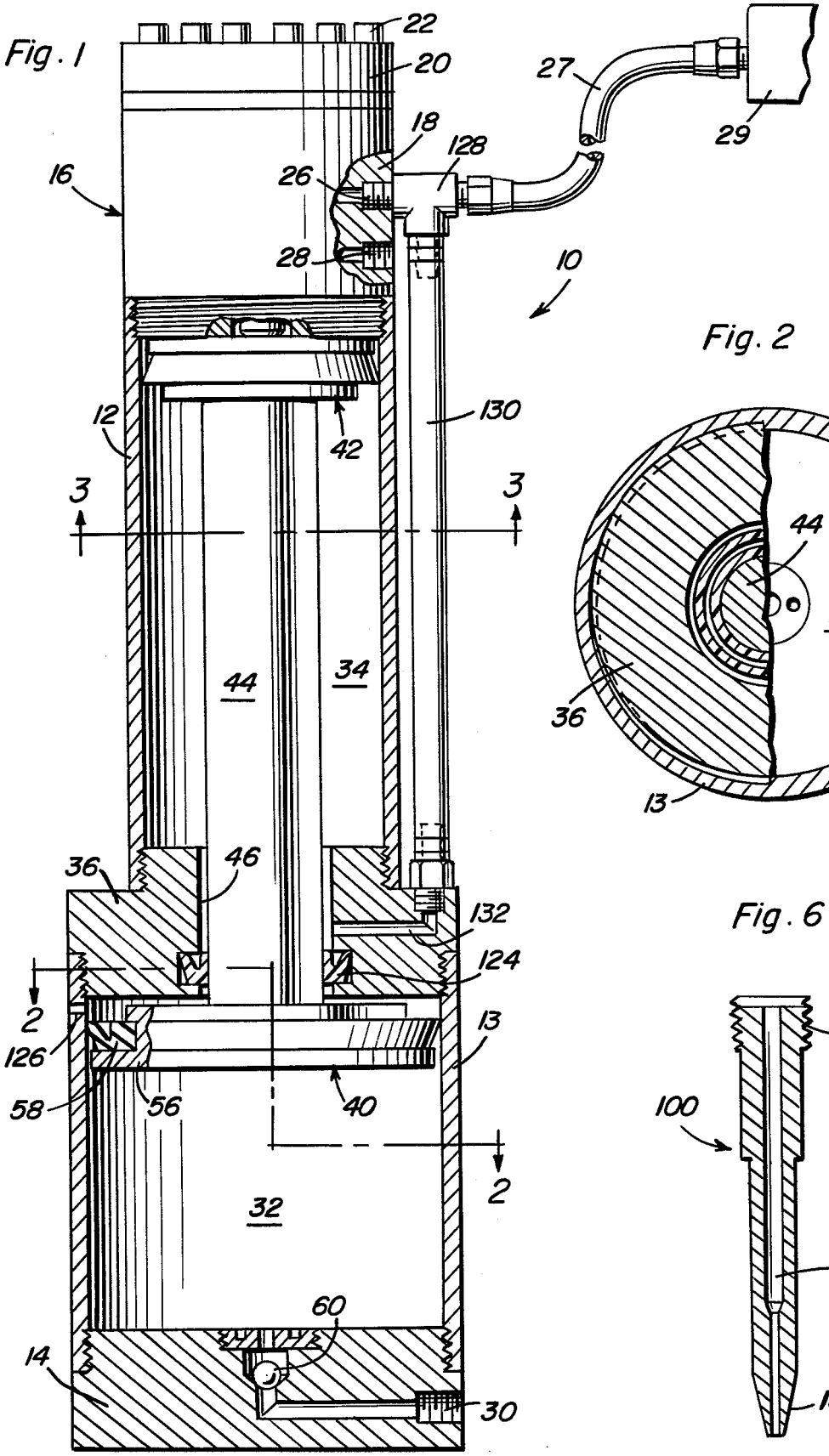
FIG. 1 is a partially sectioned, side elevation view of a vacuum pump apparatus constructed in accordance with the present invention.
Figure 2:
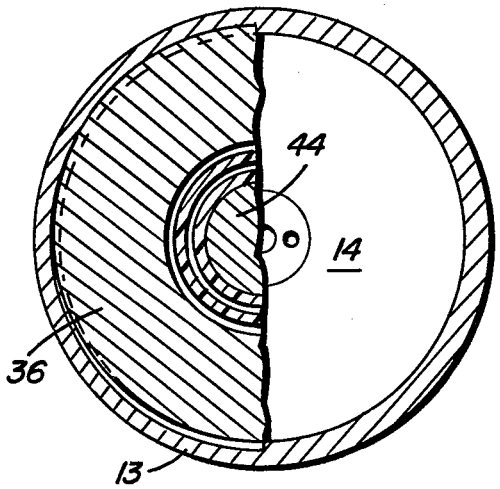
FIG. 2 is a transverse sectional view taken substantially through a plane indicated by section line 2—2 in FIG. 1.

Referring now to the drawings in detail, FIG. 1 illustrates a compressed air controlled vacuum pump apparatus generally referred to by reference numeral 10. The pump apparatus includes an elongated, cylindrical housing 12 internally threaded at one axial end for connection to an annular divider member 36. The member 36 is in turn threadedly connected to a cylindrical housing section 13 which is diametrically larger than the housing 12. The housing section 13 is threadedly connected at one axial end opposite member 36 to a pump outlet head 14. At the axial end opposite the divider member 36, the housing 12 is internally threaded for connection to a control valve assembly generally referred to by reference numeral 16. The control valve assembly includes a valve body 18 and an end section 20 secured to the valve body by a plurality of fasteners 22. The valve body 18 is provided with inlet and exhaust ports 26 and 28. The inlet port 26 is connected to a pressure regulated source of pressurized fluid such as compressed air. Toward that end, the inlet port 26 is connected by means of a T-coupling 128 and hose 27 to an air pressure regulator 29 from which regulated inlet pressure fluid is obtained for operation of the vacuum pump apparatus 10. The pressurized fluid under the regulated inlet pressure is also conducted to the divider member 36 through the T-coupling 128 and an elongated conduit 130 interconnecting the T-coupling 128 and divider member 36 externally of the housing 12. The vacuum pump apparatus 10 when supplied with the pressurized fluid from the regulator 29 will automatically operate to evacuate any desired sealed space connected to a suction pressure outlet port 30 in the outlet head member 14. The pressurized fluid under regulated inlet pressure conducted through conduit 130 to the divider member 36 is operative to exert continuous bias during automatic operation as will be explained hereinafter.

With continuing reference to FIG. 1, the housing section 13 is provided with a pump chamber 32 separated by the divider member 36 from a motor chamber 34 enclosed within the housing 12. A pump piston assembly 40 is slidably displaced within the pump chamber 32 through a fixed stroke determined by its abutment with the outlet head 14 at the end of a return stroke. The pump piston assembly 40 is diametrically larger than but otherwise similar in construction to a motor piston assembly 42, the motor piston assembly being mounted for reciprocation within the motor chamber 34. The piston assemblies 40 and 42 are interconnected by a power output piston rod 44 which extends through a central opening 46 formed within divider member 36. The motor piston assembly 42 is adapted to abut the valve body 18 at the end of a power stroke, as shown in FIG. 1.

The motor piston assembly 42 is continuously urged in the direction of movement during its power stroke by pressurized fluid under the regulated inlet pressure conducted into the motor chamber 34 on one side of the piston assembly 42 by conduit 130 and the central opening 46 in the divider member. A one-way seal 124 positioned within an internal, annular groove in the divider member wipingly engages the piston rod 44 in order to seal the motor chamber 34 during the power and return strokes. A suction pressure is, therefore, established within the pump chamber 32 on one side of the piston assembly 40 during the power stroke. The other side of the piston assembly 40 is vented during the power stroke through vent opening 126 formed in the housing section 13 adjacent to the divider member 36.

Each piston assembly 40 and 42 is provided with a rigid piston member 56 having an annular groove within which an annular flexible seal element 58 is retained for wiping engagement with the internal cylindrical wall of the housing 12 or housing section 13. The seal element 58 will effectively seal the enclosed spaces on opposite axial sides of the piston assembly from each other only when the pressure on one side is greater than that on the other side. Thus, during the return stroke, the pump piston assembly 40 will be displaced toward the outlet head 14 without effectively sealing the pump chamber 32 to reduce the load on the power output piston rod 44. The pressure developed in chamber 32 during this return stroke seats a check valve 60 in the outlet head to block any outflow through the outlet port 30 and flexes the seal element 58 radially inwardly to permit escape of trapped fluid into the vented side of the piston assembly 40. During the power stroke of the motor piston assembly 42, the pump piston assembly 40 moving away from the outlet head 14 toward the position shown in FIG. 1 will produce a suction pressure within chamber 32. The check valve 60 will accordingly open as suction is applied through the outlet port 30. Displacement of the pump piston 40 through its full power stroke is repeated each cycle until such time as a predetermined vacuum pressure is developed balancing the fluid pressure bias exerted on the motor piston assembly 42 in chamber 34. At that point, the apparatus 10 will stop operation. Operation will resume when the vacuum pressure within the chamber 32 drops below the predetermined value determined by the fluid pressure bias established within the motor chamber 34.

Figure 4:
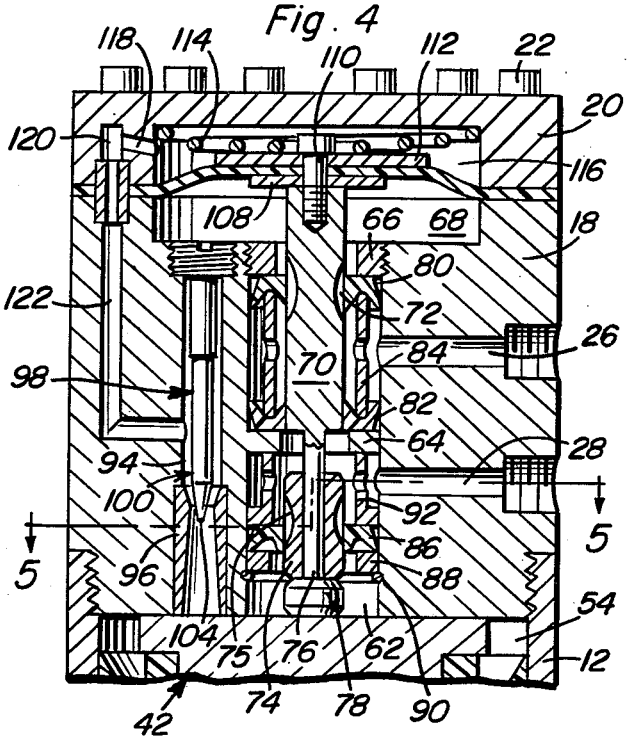
FIG. 4 is an enlarged side sectional view of the control valve assembly associated with the vacuum pump apparatus shown in FIG. 1.
Figure 3:
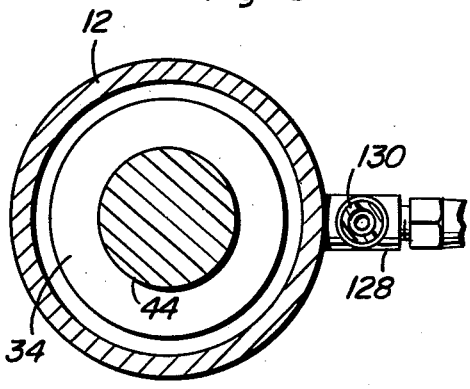
FIG. 3 is a transverse sectional view taken substantially through a plane indicated by section line 3—3 in FIG. 1.
Figure 5:
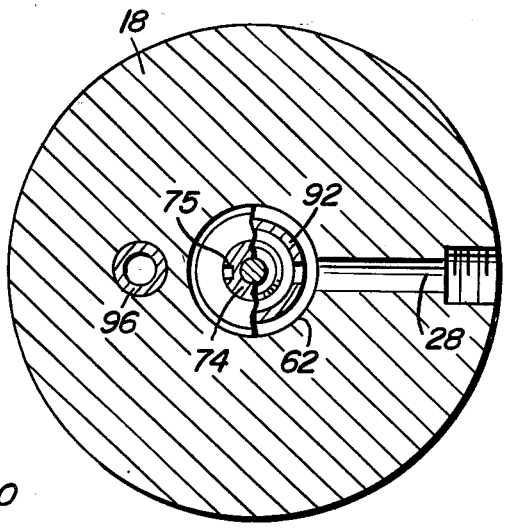
FIG. 5 is a transverse sectional view taken substantially through a plane indicated by section line 5—5 in FIG. 4.
Figure 7:
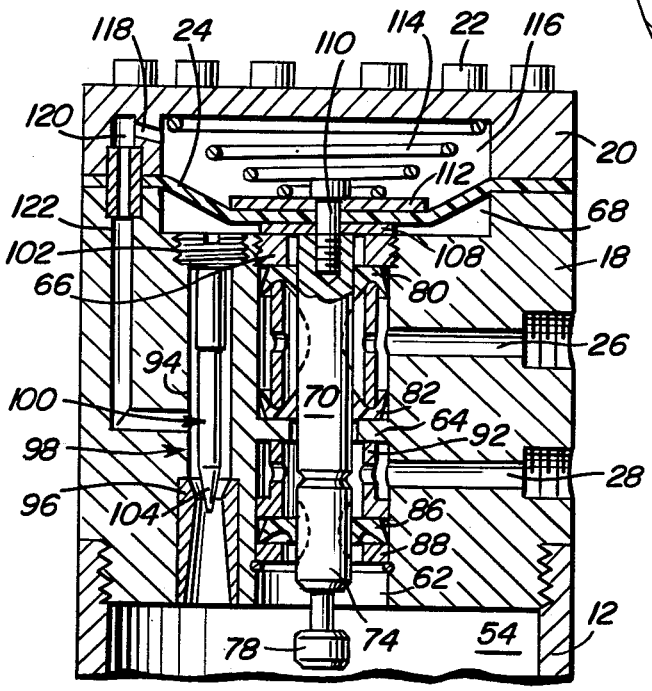
FIG. 7 is a sectional view similar to that of FIG. 4 showing the control valve assembly in another operative condition.

Referring now to FIGS. 4 and 5 in particular, the valve body 18 of the control valve assembly 16 is provided with an axial bore 62 intersected at right angles by the inlet and exhaust ports 26 and 28. The axial bore 62 is divided into two sections by an annular projection 64. One end of the axial bore 62 is provided with an annular end wall 66 which is threadedly inserted through a recess in the valve body. Aligned central openings formed in the projection 64 and end wall 66 form a loose sliding fit for a control valve element 70. The valve element 70 is formed with passage slots 72 through which unrestricted fluid communication may be established between the pressure chamber 68 and the inlet port 26 in the open position of the valve element 70, as shown in FIG. 4. The valve passage slots 72 thus control the flow of fluid to chamber 68 from the inlet port through the valve bore 62 on one side of the projection 64 while flow through the valve bore on the other side of the projection 64 to the exhaust port 28 is controlled by a movable valve section 74 provided with valve passage slots 75. The movable valve section 74 is displaceable within limits on a valve stem 76 projecting from the valve element 70. The valve stem 76 terminates at a radially enlarged actuator formation 78. The formation 78 projects from the valve body into an expansible pressure chamber 54 formed on one side of the motor piston assembly 42 opposite chamber 34 within the housing 12. In the closed position of valve element 70 as shown in FIG. 7, the movable valve section 74 is displaced into abutment with the valve element 70 and establishes fluid communication between the pressure chamber 54 and the exhaust port 28.

Positioned within the axial bore 62 of the valve body are a pair of annular flexible seal elements 80 and 82, respectively, held in abutment with end wall 66 and projection 64 by a rigid annular spacer 84 provided with openings therein. The seal elements 80 and 82 wipingly engage the valve element 70 to substantially prevent leakage from the valve bore. A third annular flexible seal element 86 is positioned within the valve bore 62 in abutment with a thrust washer 88 held assembled by an O-ring retainer 90 within the axial bore. The seal element 86 is held in abutment with the washer 88 by an annular spacer 92 also provided with openings therein.

Figure 6:
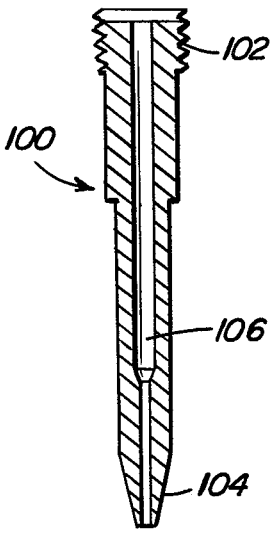
FIG. 6 is a side section view of a flow nozzle element associated with the control valve assembly shown in FIG. 4.

A second bore 94 is formed within the valve body 18 in parallel spaced relationship to the central bore 62 in order to establish fluid communication between the motor pressure chamber 54 and the valve operating pressure chamber 68. A portion of the bore 94 adjacent the pressure chamber 54 is diametrically enlarged to receive a venturi passage sleeve 96 forming part of a pressure modifying device generally referred to by reference numeral 98 which also includes an elongated flow restrictor nozzle 100 having a threaded end portion 102 by means of which it is connected to the valve body and suspended within the bore 94. The flow nozzle 100 is also provided with a tapered nose portion 104 which projects through the throat portion of the venturi sleeve 96. A restricted flow passage 106 is formed within the restrictor flow nozzle 100, as shown in FIG. 6, in order to insure a higher pressure in chamber 68 than that in pressure chamber 54 to propel the piston assembly 42 through its return stroke.

A pressure differential responsive diaphragm element 24 is held clamped in assembled relation between the valve body 18 and the end section 20 by means of the fasteners 22 aforementioned. A fastener 110 interconnects a central portion of the diaphragm element 24 with the valve element 70 and also clamps the central portion between discs 108 and 112. The disc 108 limits displacement of the valve element 70 to the closed position shown in FIG. 7 by abutment with the end wall 66. A conical spring 114 bears against the disc 112 to continuously bias the diaphragm element and valve element 70 toward the closed position. The spring 114 is enclosed within a valve operating control chamber 116 formed within the housing section 20. A connecting passage 118 extends between the control chamber 116 and aligned passages 120 and 122, respectively, formed in the housing section on 20 and valve body 18. The passage 122 is connected by a right angle portion to the bore 94 in the valve body. Since the control chamber 68 is pressurized with fluid at a pressure slightly less than the externally regulated inlet pressure when the valve element is in the open position shown in FIG. 4, the valve element will be held in its open position against the continuous bias of spring 114 and the pressure in chamber 116 lowered by its communication with chamber 54 through bore 94.

It will be apparent that the motor piston assembly 42 will be displaced through its power stroke by the fluid inlet pressure in motor chamber 34 on one side of the piston assembly when the pressure chamber 54 on the other side is vented through exhaust port 28 by valve section 74 while the valve element 70 is held in its closed position by spring 114, as shown in FIG. 7. In this position of the valve element 70, inlet port 26 will be closed and the pressures within the valve operating control chambers 68 and 116 equalized by fluid communication established through restricted flow passage 106 in the flow restriction nozzle 100, bore 94, and passages 122, 120 and 118. As the motor piston assembly 42 approaches the end of the power stroke, it engages the valve actuator formation 78 to thereby displace the valve element 70 toward the open position shown in FIG. 4. Full closing of the exhaust port 28 and pressurization of chamber 54 is, however, delayed because of the limited relative movement between the valve element 70 and the movable valve section 74. Accordingly, complete blockage of the exhaust port occurs only when valve element 70 reaches the fully open position at the end of the power stroke. The chamber 54 is then pressurized after displacement of the valve element 70 to the open position, by restricted fluid flow from the pressurized chamber 68 to the pressure chamber 54 at a flow rate dependent upon the restriction of flow through nozzle 100 and the pressure in chamber 54 required to propel the piston assembly 42 through its return stroke. A pressure in chamber 54 lower than the regulated inlet pressure in chamber 34 will cause return movement of the piston assembly 42 because of the larger pressure face on that side of the piston assembly exposed to the fluid in chamber 54.

To understand the function of the pressure modifying device 98, one must consider the action that occurs when opening movement of the valve element 70 begins as the motor piston assembly 42 approaches the end of its power stroke. Air at a high velocity is then conducted by the nozzle 100 from chamber 68 and passes through the throat of venturi 96 to enter pressure chamber 54 causing a lowering of the pressure in bore 94. The pressure in chamber 116 is thereby lowered to insure that movement of valve element 70 continues toward the fully open position under the pressure in chamber 68 against the bias of spring 114. Movement of the valve section 74 from its position venting pressure chamber 54 is delayed until the valve element 70 nears its fully open position so that the jet discharge from venturi 96 is momentarily vented during valve travel to insure fast and complete opening of valve element 70. Once the valve section 74 closes the exhaust port 28, pressure builds up in chamber 54 to begin the return stroke of piston assembly 42. The pressure in chamber 54 at this stage is, however, lower than that in chamber 68 so that the jet discharge from venturi 96 continues and thereby maintains the pressure reduction in bore 94 and chamber 116 relative to the pressure in chamber 54. The pressure differential between opposing chambers 68 and 116 will therefore continue to exceed the bias of spring 114 on diaphragm 24 to hold valve element 70 open until the piston assembly 42 reaches the end of the return stroke. At that point, pressure in chamber 54 rises until flow through venturi 96 and its pressure lowering effect on chamber 116 ceases. The pressures in chambers 54 and 116 then equalize to balance the pressure in chamber 68 enabling spring 114 to close valve element 70. Valve section 74 then opens to vent chamber 54 in order to initiate the power stroke.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a source of fluid under pressure and a power output member reciprocated through a fixed power stroke, a fluid motor device for displacing the power output member through a return stroke from one end of said power stroke, comprising a housing enclosing a motor pressure chamber, a motor piston connected to the power output member and slidably mounted in the housing, a control valve assembly connected to the housing for establishing fluid communication between said source and the motor pressure chamber to effect displacement of the motor piston through the return stroke, including a valve body, a valve element movably mounted in the valve body and displaceable between operative positions, respectively, conducting pressurized fluid from said source to the motor pressure chamber and depressurizing the motor pressure chamber, means for continuously biasing the valve element to one of said operative positions, actuating means engageable by the motor piston at said one end of the power stroke for displacement of the valve element to the other of the operative positions in which pressurized fluid is conducted from the source to the motor pressure chamber, fluid pressure means connected to said source for holding the valve element in said other of the operative positions during movement of the motor piston through the return stroke, and pressure control means fluidly connected to the fluid pressure holding means for regulating pressurization of the motor pressure chamber during the return stroke of the motor piston, said fluid pressure holding means comprising a diaphragm connected to the valve element, means within the housing enclosing opposing pressure chambers on opposite sides of the diaphragm, said valve element conducting unrestricted flow of the pressurized fluid from the source to one of the opposing pressure chambers in said other of the operative positions thereof, and pressure modifying means for establishing fluid communication between the pressure control means and the other of the opposing chambers.

2. The combination of claim 1, including a vacuum pump connected to the power output member.

3. The combination of claim 2, wherein said vacuum pump includes a suction chamber enclosed in said housing and having inlet and outlet means, a pump piston connected to the power output member and slidably mounted in the suction chamber, and means connected to the housing for limiting movement of the power output member through said fixed power and return strokes.

4. The combination of claim 3, including means for continuously biasing the motor piston toward the valve body during said power stroke.

5. The combination of claim 4, including means movably mounted on the valve element for delaying pressurization and depressurization of the motor pressure chamber in response to displacement of the valve element between said operative positions.

6. The combination of claim 1, wherein said pressure modifying means includes flow nozzle means for conducting restricted flow of fluid from said one of the opposing pressure chambers to the motor pressure chamber when the valve element is in said one of the operative positions, and venturi conduction means in fluid communication with the other of the opposing pressure chamber for reducing the pressure therein in response to said restricted flow into the motor pressure chamber from said one of the opposing pressure chambers.

7. The combination of claim 1, including means movably mounted on the valve element for delaying pressurization and depressurization of the motor pressure chamber in response to displacement of the valve element between said operative positions.

8. The combination of claim 1, including means for exerting a continuous bias on the power output member during the power and return strokes.

9. In combination with a fluid motor having a piston displaceable through a power stroke and a return stroke under the force exerted by pressurization of a pressure chamber, a control valve assembly comprising a valve body, a valve element displaceable between operative positions respectively pressurizing and depressurizing said pressure chamber, flow restrictor means for conducting a restricted flow of fluid into the pressure chamber when the valve element is in one of the operative positions thereof, a source of fluid under pressure from which said fluid is conducted to the pressure chamber through said flow restrictor means, actuating means engageable by the piston for displacing the valve element to said one of the operative positions, means continuously biasing the valve element to the other of the operative positions, and means responsive to said restricted flow of fluid to the pressure chamber for holding the valve element in said one of the operative positions against said continuous bias during the return stroke of the piston, said flow responsive means including pressure responsive valve operator means connected to the valve element, venturi passage means through which said restricted flow into the pressure chamber is conducted for producing a reduced pressure, and means for applying said reduced pressure in the venturi passage means to the pressure responsive valve operator means.

10. In combination with a source of fluid under intensity regulated pressure and a power output member reciprocated through a fixed power stroke by a constant force, a fluid motor device for displacing the power output member through a return stroke from one end of said power stroke, comprising a housing enclosing a motor pressure chamber, a motor piston connected to the power output member within said chamber, a control valve assembly for establishing fluid communication between said source and the motor pressure chamber to effect displacement of the motor piston through the return stroke, including a valve body, a valve element movably mounted in the valve body and displaceable between operative positions, respectively conducting pressurized fluid from said source to the motor pressure chamber and depressurizing the chamber, means for continuously biasing the valve element to one of said operative positions, actuating means engageable by the motor piston at said one end of the power stroke for displacement of the valve element to the other of the operative positions in which pressurized fluid is conducted from the source to the motor pressure chamber, and valve holding means fluidly connected to the pressure source for holding the valve element in said other of the operative positions during the return stroke, comprising a diaphragm connected to the valve element, means within the housing enclosing opposing pressure chambers on opposite sides of the diaphragm, said valve element conducting unrestricted flow of the pressurized fluid from the source to one of the opposing pressure chambers in said other of the operative positions thereof, and pressure reducing means fluidly connected to the other of the opposing chambers for unbalancing equalized pressures in said opposing pressure chambers only during the return stroke, whereby the valve element returns to said one of the operative positions under the continuous bias exerted thereon at the end of the stroke.

11. The combination of claim 10 wherein said pressure reducing means includes jet means for conducting a restricted inflow of fluid from said one of the opposing pressure chambers to the motor pressure chamber when the valve element is in said other of the operative positions, and venturi passage means in fluid communication with the other of the opposing pressure chambers for reducing the pressure therein in response to said restricted inflow of fluid into the motor pressure chamber during the return stroke of the motor piston.

* * * * *